US006536409B1

(12) United States Patent
Takahashi et al.

(10) Patent No.: US 6,536,409 B1
(45) **Date of Patent: *Mar. 25, 2003**

(54) THROTTLE VALVE CONTROL MECHANISM FOR ENGINE

(75) Inventors: Masanori Takahashi, Shizuoka (JP); Goichi Katayama, Shizuoka (JP)

(73) Assignee: Sanshin Kogyo Kabushiki Kaisha, Shizuoka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/357,459

(22) Filed: Jul. 20, 1999

(30) Foreign Application Priority Data

Jul. 21, 1998 (JP) ..... 10-204661

(51) Int. Cl.[7] ..... F02D 11/04
(52) U.S. Cl. ..... 123/336; 123/400; 440/87
(58) Field of Search ..... 123/336, 400, 123/403, 59.5, 195 P, 195 HC; 440/87

(56) References Cited

U.S. PATENT DOCUMENTS

| | | | | |
|---|---|---|---|---|
| 2,635,595 A | * | 4/1953 | Raleigh | 123/403 |
| 4,971,006 A | | 11/1990 | Imaeda | 123/400 |
| 4,995,370 A | | 2/1991 | Imaeda et al. | 123/583 |
| 5,065,723 A | * | 11/1991 | Broughton et al. | 123/406.74 |
| 5,606,952 A | | 3/1997 | Kanno et al. | 123/406.74 |
| 5,655,500 A | | 8/1997 | Kato | 123/336 |
| 5,704,334 A | * | 1/1998 | Kato | 123/336 |
| 5,803,044 A | | 9/1998 | Kato | 123/336 |
| 5,957,108 A | | 9/1999 | Kato | 123/336 |

* cited by examiner

*Primary Examiner*—Andrew M. Dolinar
(74) *Attorney, Agent, or Firm*—Knobbe, Martens, Olsen & Bear LLP

(57) ABSTRACT

A throttle valve control mechanism for an internal combustion engine. In one feature of the invention, the engine has multiple cylinders extending generally horizontally, spaced vertically relative to each other. The engine also has an air induction system extending generally horizontally. The air induction system includes a plurality of air intake ducts each having a throttle valve. Each throttle valve has a throttle valve shaft extending generally vertically and linked together. A throttle valve control mechanism is provided. The throttle valve control mechanism has a throttle lever for rotating the throttle valve and the throttle lever is movable in a plane existing generally horizontally. Almost of the other part of the throttle valve control mechanism is movable in a plane existing generally vertically. If the engine is mounted on an outboard motor and encircled by a protective cowling, the other part of the throttle valve control mechanism is placed between the engine and the protective cowling. In another feature of the invention, the throttle valve control mechanism has a non-linear device so that the throttle valve opening changes non-linearly as compared with its input operation.

38 Claims, 7 Drawing Sheets

THROTTLE VALVE CONTROL MECHANISM FOR ENGINE

BACKGROUND OF THE INVENTION

1. Field of the Invention

The invention relates to a throttle valve control mechanism for an engine and more particularly to a throttle valve control mechanism that is most suitable to an engine of an outboard motor.

2. Description of Related Art

Recently, some outboard motors incline to utilize four stroke engines. One reason for this tendency is that emissions from the four stroke engines are clean rather than those of two stroke crankcase compression engines. An engine for an outboard motor generally has a single cylinder bore or multiple cylinder bores extending generally horizontally in its engine body. Also an air induction system is provided for introducing air charge to the single or multiple combustion chamber(s) in the engine body. Usually, the air induction system for a four stroke engine has a single or multiple air intake duct(s) extending generally horizontally along the cylinder bore(s) and a common plenum chamber placed upstream of the air intake duct(s). It is desirable to make the air intake ducts proper lengths for improving engine power, particularly the torque characteristic under acceleration conditions from low or medium speeds by using the inertia charge effect.

In the meantime, conventionally a throttle valve for admitting air charge to the combustion chamber(s) is contained in a throttle body placed upstream of the plenum chamber. Due to this arrangement, the length(s) between the throttle valve and the combustion chamber(s) tend to be relatively long. Thus, the engine cannot response so quickly to the operator's desire. Accordingly, the operator is likely to have bad feeling in engine operation. In order to shorten the length(s) as much as possible, it can be proposed to dispose the throttle valve within the (each) throttle duct.

If the engine has only a single cylinder, a throttle valve control mechanism of the throttle valve could be relatively simple. However, if multiple cylinders are provided, the control mechanism would be somewhat complicated. In addition to that, the engine is encircled with a protective cowling and there is only narrow space between the engine body and the protective cowling. Under the circumstances, it is a problem how to dispose a throttle valve control mechanism in this narrow space. This problem comes up not only to a four stroke engine but also to, for example, a two stroke crankcase compression engine if, for example, such an engine has an air intake duct extending between an engine body and a protective cowling.

It is, therefore, a principal object of this invention to provide a multiple cylinder engine wherein a throttle valve control mechanism is suitably provided in space between an engine body and a protective cowling.

Also, an engine for an outboard motor is quite often operated at a fixed engine speed within a low or medium speed range. Thus, it is desirable to make the throttle valve control insensitive at this speed range so that the operator can keep the engine speed in the generally fixed state easily. Another engine may require another characteristic in the throttle valve control.

It is, therefore, another object of this invention to provide an engine wherein a throttle valve control mechanism can have various control characteristics.

SUMMARY OF THE INVENTION

In accordance with one aspect of this invention, an internal combustion engine comprises a plurality of generally horizontally extending bores having their axis spaced vertically relative to each other. A plurality of pistons are provided and each piston reciprocates within a respective one of the cylinder bores. A cylinder head closes one end of the cylinder bores. Each of the cylinder bores, the pistons and the cylinder head generally defines a respective combustion chamber for burning an intake charge. An air induction system communicates with the combustion chambers for supplying at least air charge thereto. The air induction system includes a plurality of air intake ducts. Each of the air intake ducts has a throttle valve for admitting the air charge to the combustion chamber. Each of the throttle valves has a valve shaft which axis extends generally vertically. Respective throttle valves are linked together. Means are provided for controlling the throttle valves. The throttle valve control means have an actuator being movable in a plane existing generally horizontally for rotating the valve shafts about each axis so that the openings of the throttle valves are controlled. Almost of the other part of the throttle valve control means are movable in a plane existing generally vertically.

In accordance with another aspect of this invention, an internal combustion engine comprises an engine body having at least one cylinder. The cylinder includes a cylinder bore, a piston reciprocating within the cylinder bore and a cylinder head closing the cylinder bore. The cylinder bore, the piston and the cylinder head generally defines a combustion chamber for burning intake charge. The engine further comprises an air induction system for supplying at least air charge to the combustion chamber. The air induction system includes a throttle valve for admitting the air charge to the combustion chamber. The throttle valve has a valve shaft around which the throttle valve rotates. Means are provided for rotating the valve shaft non-linearly as compared with an input operation thereof.

Further aspects, features and advantages of this invention will become apparent from the detailed description of the preferred embodiments which follow.

DETAILED DESCRIPTION OF THE PREFERRED EMBODIMENTS OF THE INVENTION

Figure 1:
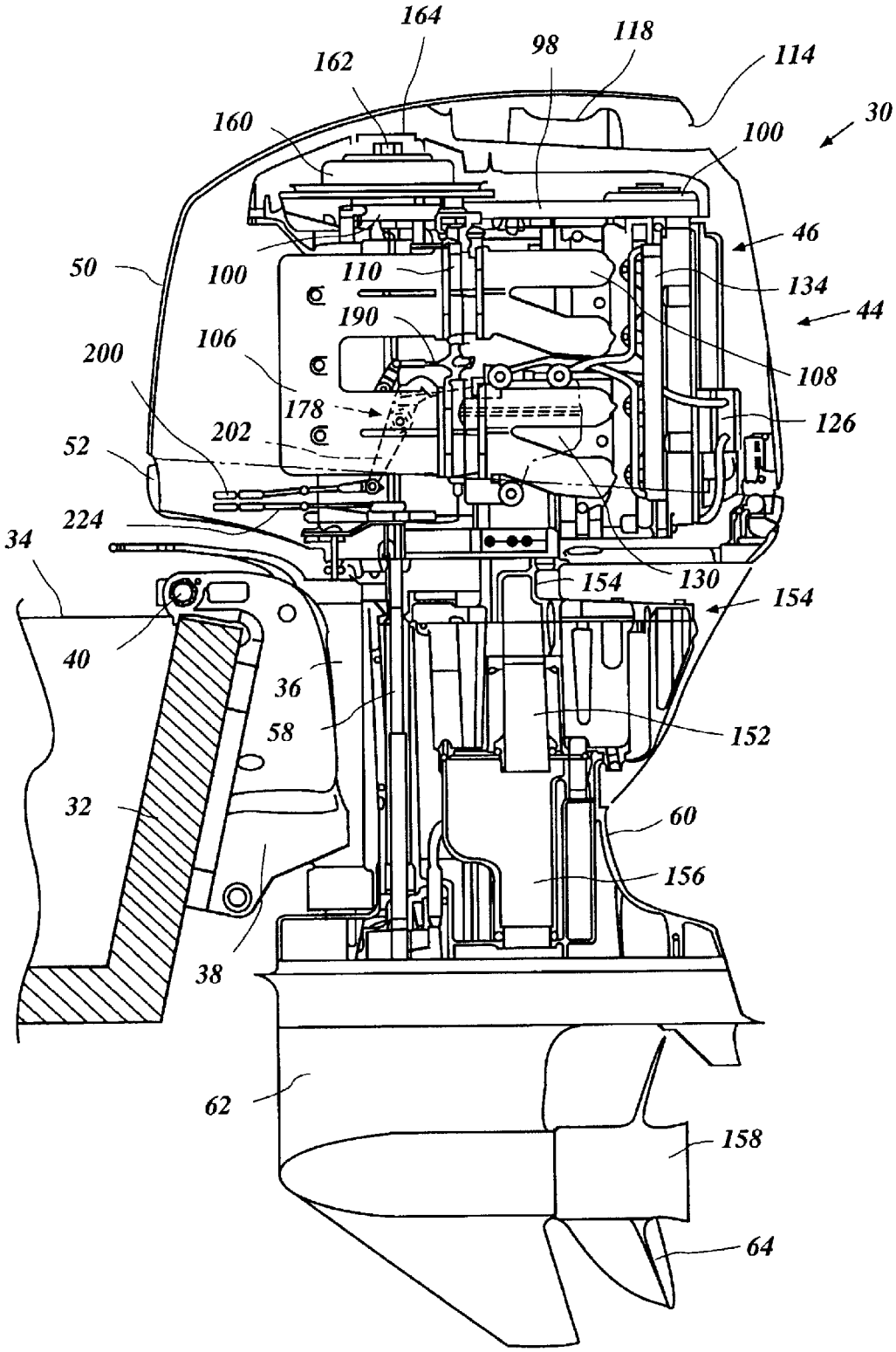
FIG. 1 is a partly cross-sectional, side elevational view showing an outboard motor embodying features of this invention and mounted on an associated watercraft which is partially shown. A protective cowling, an engine cover and an upper housing including an exhaust system are sectioned to show an engine, engine components and a certain structure of the outboard motor under the engine.
Figure 2:
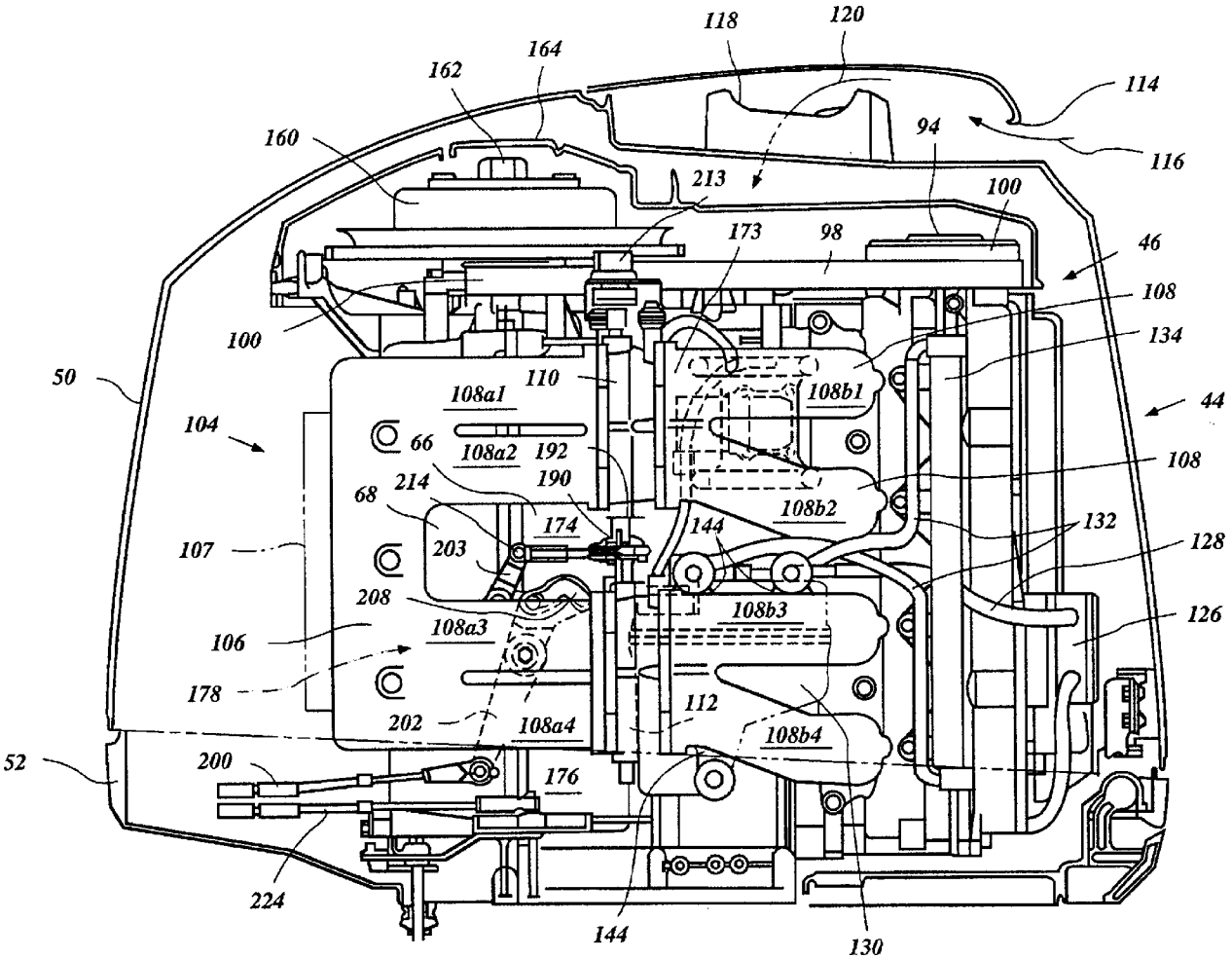
FIG. 2 is an enlarged, side elevational view showing a power head of the outboard motor. The protective cowling and the engine cover are also sectioned.

At first, the general overall environment of an exemplary outboard motor wherein the invention is practiced will be described primarily with reference to FIGS. 1 through 4.

An outboard motor 30 is mounted on a transom 32 of an associated watercraft 34 by a swivel bracket 36 and a cramp bracket 38. The whole body of the outboard motor 30 is pivotally supported around a generally vertically extending axis of the swivel bracket 36 and this connection allows the whole body of the outboard motor 30 to be steered in a suitable manner. Meanwhile, it is also pivotally supported around a horizontally extending axis 40 of the cramp bracket 38 so that its tilting movement and trimming movement are practicable also.

In the following descriptions, the term "forward" or "forwardly" will mean at or to the side where the cramp bracket 38 is located and the term "rearward" or "rearwardly" will mean at or to the opposite side of this forward side unless described otherwise.

A power head 44 is located at the top of the outboard motor 30. The power head 44 includes a powering internal combustion engine 46. This engine 46 operates on a four stroke principle and has four cylinders 48 disposed in line and spaced vertically relative to each other. The power head 44 further includes a top cowling 50 and a bottom cowling 52. These top and bottom cowlings 50,52 generally completely encircle the engine 46 so as to protect it. For instance, water is prevented from splashing over the engine 46. The top cowling 50 is detachably affixed to the bottom cowling 52 so as to ensure access to the engine 46 for maintenance.

The engine 46 has a crankshaft 56 (see FIG. 3 or FIG. 4) extending generally vertically. Since the body of the outboard motor 30 can be tilted as noted above, the term "vertically extending" means that the body of outboard motor 30 is in the non-tilted position (including the non-trimmed position), i.e., in the most lowered position as shown in FIG. 1 and thus the crankshaft 56 is extending perpendicularly. Also, the term "horizontally extending" means extending in a plane making a right angle with a perpendicular plane. In addition, the term "the body of the outboard motor 30" does not include the swivel bracket 36 and the cramp bracket 38 unless explained otherwise.

A driveshaft 58 continues from the crankshaft 56 and extends vertically and downwardly in an upper housing 60 and also a lower housing 62. The bottom end of the driveshaft 58 is connected with a propeller shaft (not shown) extending generally horizontally by means of a bevel gear transmission (not shown). At the end of the propeller shaft, a propeller 64 is affixed. Through the crankshaft 56, driveshaft 58, the bevel gear transmission and the propeller shaft, the engine 46 powers the propeller 64.

Figure 3:
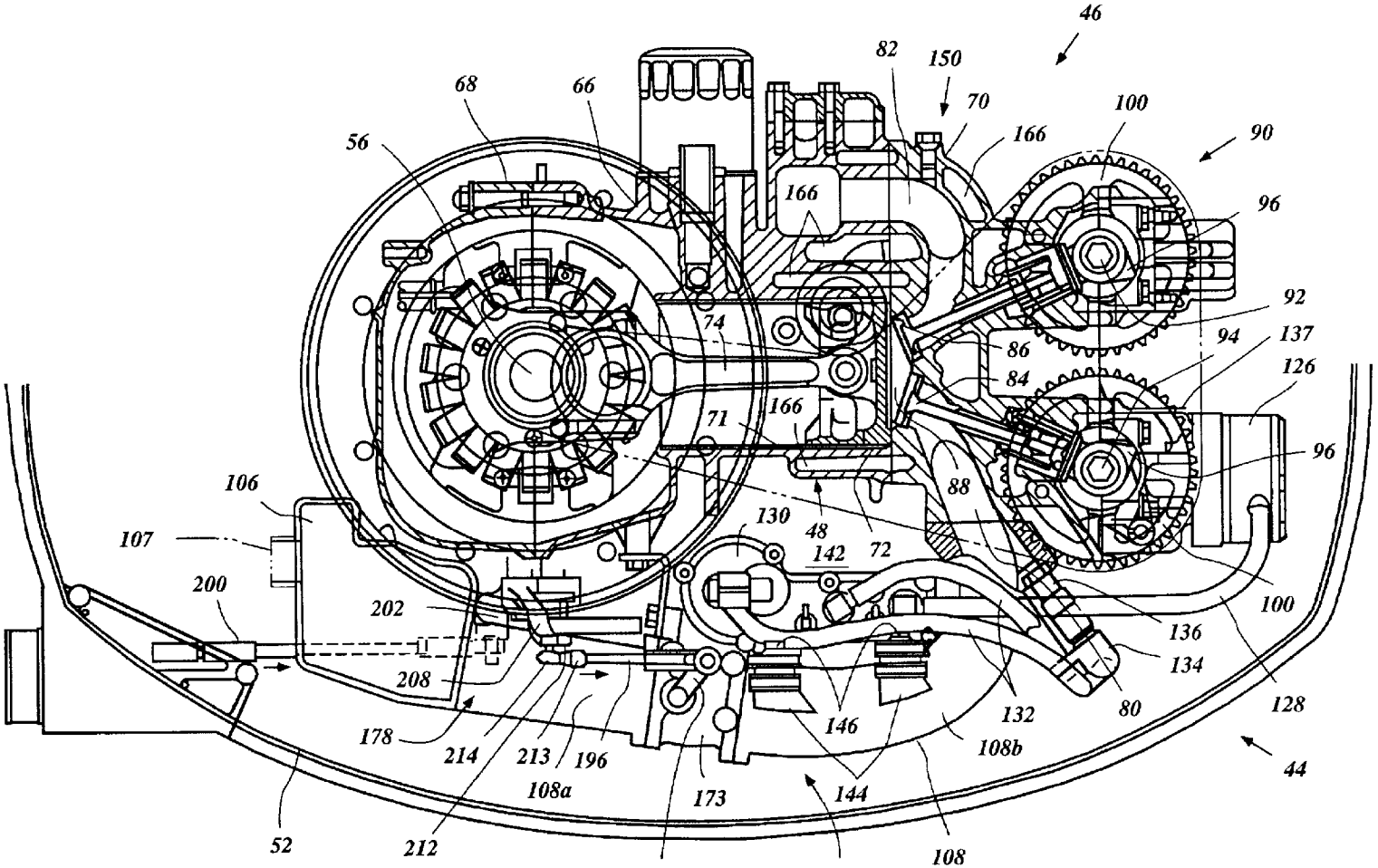
FIG. 3 is a top plan view showing the power head. A certain cylinder is sectioned at a plane including its intake and exhaust passages, while a plenum chamber is sectioned generally at its vertical center line. Only a half part of the protective cowling on the port side is shown. Also, a flywheel and a camshaft drive are shown in phantom since these components would be seen in this cross-section.
Figure 4:
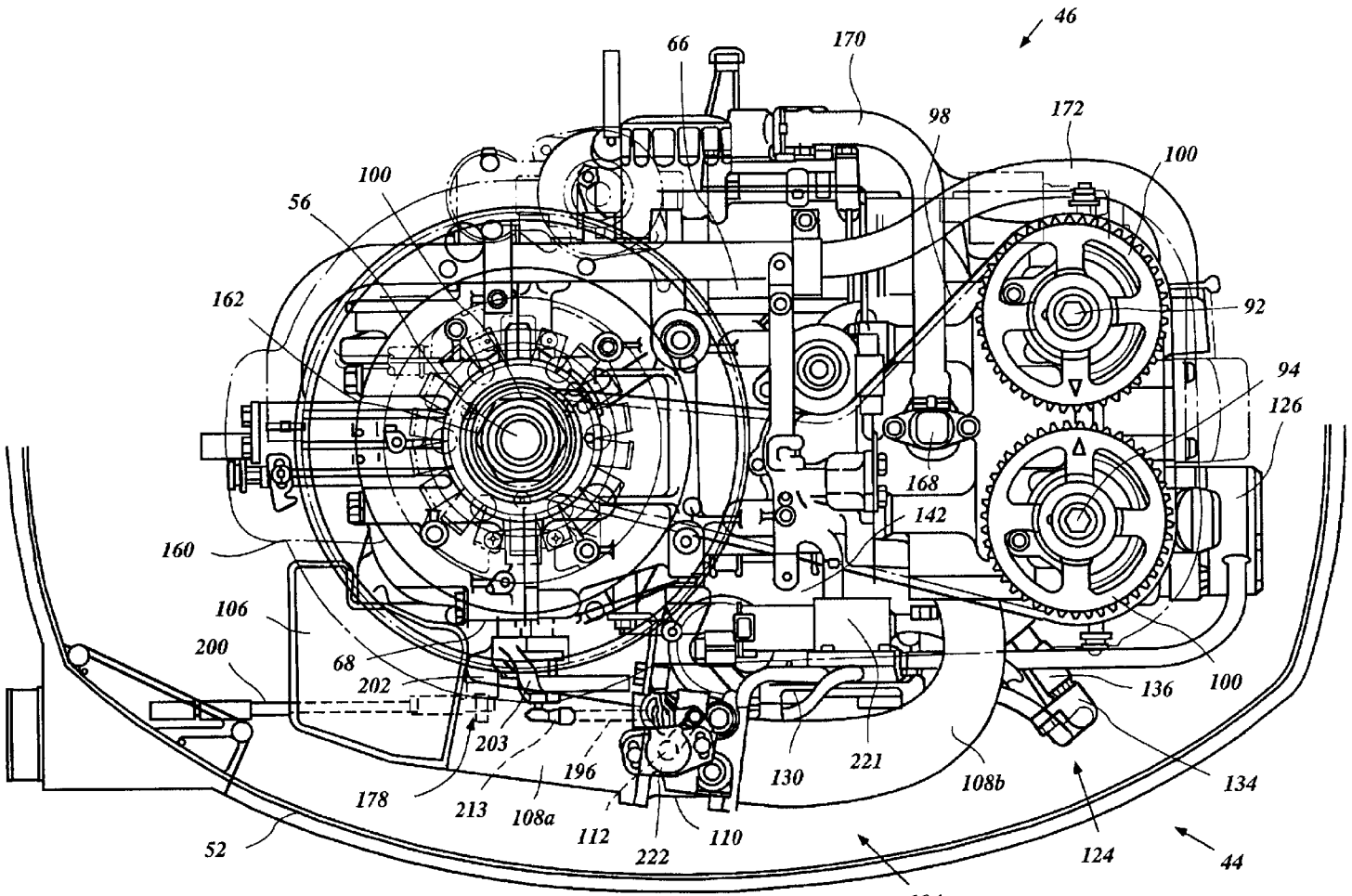
FIG. 4 is another top plan view of the power head looking along the camshaft drive thereof. Like in FIG. 3, the plenum chamber is sectioned generally at its vertical center line and only the half part of the protective cowling on the port side is shown.

As best seen in FIG. 3, the engine 46 generally comprises a cylinder block 66, a crankcase chamber 68 and a cylinder head 70 and all members of these sections 66,68,70 are generally made of aluminum alloy casting. The cylinder block 66 generally has two openings. One opening is closed by the cylinder head 70. The cylinder head 70 is located at the most rearward position. Another opening is closed by the crankcase 68 defined by one or more crankcase members. The crankcase 68 is placed at more forward position. The cylinder block 66 contains four cylinders 48 therein as noted above. Each cylinder 48 has a cylinder bore 71, which axis extends generally horizontally and a piston 72 reciprocates therein. The pistons 72 are connected to the crankshaft 56 located in the crankcase chamber 68 via connecting rods 74 so that the reciprocal movement of the pistons 72 rotates the crankshaft 56.

Air intake passages 80 and exhaust passages 82 are formed in the cylinder head 70. The exhaust passages 82 further extends in the cylinder block 66. Each air intake passage 80 has one or more intake valves 84, while each exhaust passage 82 has also one or more exhaust valves 86. The air intake passage 80 and the exhaust passage 82 are branched off to sub-passages corresponding to respective valves 84,86. The cylinder bore 71, the piston 72, the cylinder head 70, the intake valves 84 and the exhaust valves 86 generally define a combustion chamber 88.

The intake valves 84 and the exhaust valves 86 are activated by a camshaft drive mechanism 90. That is, the air intake passages 80 and the exhaust passages 82 will be connected or disconnected to the combustion chambers 88 when the intake valves 84 and the exhaust valves 86 are brought into open or closed positions by the camshaft drive mechanism 90. The camshaft drive mechanism 90 has an intake camshaft 92 and an exhaust camshaft 94 both having cam lobes 96. When these camshafts 92,94 rotate, the cam lobes 96 activate the intake valves 84 and the exhaust valves 86 to open or close the air intake passages 80 and the exhaust passages 82.

Both of the camshafts 92,94 are rotated by the crankshaft 56 with a cog belt or chain 98 as an endless transmitter. For this driving purpose, pulleys or sprockets 100 as a driving wheel and driven wheels are affixed on the camshafts 92, 94 and the crankshaft 56 in a suitable manner such as press fit and bolt-on and the endless transmitter 98 is wound around these driving and driven wheels 100. The open and close timings of the intake valves 84 and the exhaust valves 86 are determined by means of the arrangement of the cam lobes 96 on the camshafts 92,94 and the relationships in the rotational speeds of the camshafts 92,94 versus the crankshaft 56. The camshafts 92,94 are rotated at a half speed of the crankshaft 56.

Intake charge, which is mixture of air and fuel, is burnt in the combustion chambers 88 every combustion or burning stroke. Air is introduced to the combustion chambers 88 by an air induction system 104 extending generally horizontally on the port side of the engine 46.

The air induction system 104 includes a plenum chamber 106, air intake ducts 108, throttle bodies 110 and the air intake passages 80 in the cylinder head 70. In this embodiment, the air intake ducts 108 are made of aluminum alloy casting and formed with upstream duct members **108*a* and intake manifolds 108*b*. The upstream duct members 108*a* are integrated with the plenum chamber 106. The air intake passages 80 in the cylinder head 70 generally go slightly rearward and the intake ducts 108, then, turn forwardly and go forward generally along curvature of the top cowling 50 to the plenum chamber 106. This curvature is temperate because air charge can flow without confronting particular resistance. As best seen in FIG. 3, the intake ducts 108 extend generally along the sides of the cylinder bores 71**.

The plenum chamber 106 is provided for smoothing air charge therein. That is, the plenum chamber 106 primarily prevents intake pulsation and, in addition, precludes the intake pulsation in respective cylinders 48 from influencing to each other. The plenum chamber 106 is positioned generally opposite side of the air intake passages 80. In other words, the air intake passages 80 are placed at a generally rearward position of the engine 46, while the plenum chamber 106 is placed at a generally forward position of the engine 46. The plenum chamber 106 has an atmospheric air inlet opening juxtaposed to the crankcase 68.

Each throttle body 110 is provided between the upstream duct member 108*a* and the intake manifold 108*b* and contains a throttle valve (not shown) therein. The throttle bodies 110 are relatively precisely machined and has straight center lines. The throttle valve in each throttle body 110 is affixed to a valve shaft 112, which axis extends generally vertically. All of the valve shafts 112 are linked together and rotatable so that the throttle valves are opened or closed. This vertical arrangement of the valve shafts 112 is useful because related members will not project sideways. A throttle valve control mechanism will be described more in detail later.

Air is, at first, introduced into inside of the top and bottom cowlings 50,52 from an air inlet opening 114 formed at the top and rear portion of the top cowling 50 as indicated by the arrow 116. Then, the air goes through air funnels 118 as indicated by the arrow 120 and finally reaches the inlet opening 107 of the plenum chamber 106. The air is, then, supplied through the air induction system 104 to the combustion chambers 88. The inlet opening 107 can be positioned at any side of the plenum chamber 106, i.e., for example, at the forward side as shown in phantom line (see FIGS. 2 and 3). The air induction system 104 will be described again later.

The engine 46 has a fuel supply system 124 for supplying fuel, which is another component of the intake charge, to the combustion chambers 88. Gasoline is used as the fuel in this engine 46. The fuel supply system 124 generally includes a fuel supply tank (not shown), a fuel pump 126, a fuel supply conduit 128, a vapor separator 130, fuel delivery conduits (including a return conduit) 132, a fuel rail 134 and fuel injectors 136. The fuel supply tank is placed on the associated watercraft 34 and connected to the fuel pump 126 with a conduit (not shown). Fuel is sent to the fuel pump 126. The fuel pump 126 is affixed on a camshaft cover 137 and raises pressure in the fuel. The fuel is supplied to the vapor separator 130. The vapor separator 130 is provided for discharging vaporized fuel to the atmosphere, if any. The vapor separator 130 is placed at a space 142 defined between the cylinder block 66 and the air intake ducts 108. Also, it is mounted on brackets 144 formed at one of the intake manifold 108*a* of the air intake ducts 108 with bolts 146.

The pressurized fuel is delivered to the fuel rail 134 through the fuel delivery conduit 132. The fuel rail 134 is a rigid pipe and further delivers the fuel to the respective fuel injectors 136. The fuel injectors 136 are affixed on the cylinder head 70 so that their injector nozzles (not shown) are exposed to the air intake passages 80. The nozzles are directed to the combustion chambers 88 and spray the fuel into the intake passage 80 in the proximity of the intake valves 84.

The timing and the fuel amount are controlled by a computerized control device (not shown). Thus, the sprayed fuel is mixed with the air in the air intake passage 80 and forms the intake charge or air fuel mixture. This intake charge is introduced into the combustion chambers 88 when the intake valves 86 are opened. Excess fuel is returned to the vapor separator 130 through the delivery (return) conduit 132.

Usually, the vapor separator 130 is mounted on the cylinder block 66 that tends to have much heat. However, the vapor separator 130 in this arrangement is affixed to the intake manifold 108*b*. As aforenoted, the intake duct members 108*a,b* are made of aluminum alloy casting. This material has very good thermal conductivity. In addition, air, which is relatively cool, flows therethrough. Under these good conditions, the vapor separator 130 will not be heated and rather than be cooled down. This is useful in restoring vapor to the liquid state.

Although not shown, the engine 46 has a firing system. The firing system includes spark plugs that are affixed at the cylinder head 70 so that firing electrodes are exposed to the respective combustion chambers 88. Firing timings are controlled by the computerized control device and intake charge is burnt every combustion cycle.

The engine 46 further has an exhaust system 150 for discharging the burnt charge or exhaust gasses from the combustion chambers 88 outside of the engine 46 and finally outside of the outboard motor 30. The exhaust system 150 includes the aforenoted exhaust passages 82, exhaust conduits or manifold 152 partly formed in an exhaust guide 154 (see FIG. 1) which is located under the engine 46 and partly formed in the upper housing 60 and an exhaust expansion chamber 156 in the upper housing 60. The exhaust gasses flow through the exhaust passages 82, the exhaust conduits 152 and then the exhaust expansion chamber 156. When going through the exhaust expansion chamber 156, exhaust noise is effectively attenuated and the exhaust gasses are discharged into the body of water surrounding the outboard motor 30 through a passage (not shown) formed in the lower housing 62 and a boss 158 of the propeller 64.

At the top of the crankshaft 56, a flywheel 160 is affixed with a nut 162. The flywheel 160 contains electric power generator components therein and hence forms a flywheel magneto also. The generated power will be used for firing the spark plugs and other purposes. An engine cover 164 is affixed on the engine 46 in a suitable manner to cover up the top of the engine 46. That is, the rotational members such as the flywheel 160, the driven wheels 100 and the endless transmitter 98 are completely covered so that the operator will not be hurt even in case the top cowling 50 is detached during the engine operation.

The engine 46 has a water cooling system comprising water jackets 166 formed in the cylinder block 66 and the cylinder head 70. The water cooling system has also a thermostat 168 to adjust water temperature and a water discharge pipe 170 is provided (see FIG. 4).

Incidentally, a blow-by gas passage 172 is provided for returning blow-by gasses from the cylinder head 70 to the crankcase 68.

The air induction system 104 will now be described more in detail still with reference to FIGS. 1 through 4.

As described above, the air induction system 104 has the upstream duct members 108*a* integrated with the plenum chamber 104. The upstream duct members 108*a* are, more specifically, constructed with four branch ducts 108*a*1,*a*2, *a*3,*a*4. Meanwhile, the intake manifolds 108*a* are also constructed with four runners 108*b*1,*b*2,*b*3,*b*4. The two runners 108*b*1,*b*2 are integrated with each other to form one intake manifold 108*b*, while the other two runners 108*b*3,*b*4 are also integrated together to form another intake manifold 108*b*. The throttle bodies 110 connect the respective upstream branch ducts 108*a*1,*a*2,*a*3,*a*4 and the runners 108*b*1,*b*2,*b*3,*b*4 so that four lines of the air intake ducts 108 are completed. That is, each line of the air intake ducts 108 is formed with at least three pieces that are the upstream intake duct member 108*a*, the throttle body 110 and the runner 108*b*.

In the top plan view (see FIG. 3), these upstream branch ducts 108*a*1,*a*2,*a*3,*a*4 are generally straight pipes and extend horizontally along the cylinder bores 71. The runners 108*b*1, *b*2,*b*3,*b*4 also extend along the cylinder bores 71, but are gradually curved and connected to the intake passages 80 as described above. However, at least a portion 173 positioned mostly upstream is formed straightly. That is, both of the upstream branch ducts 108*a*1,*a*2,*a*3,*a*4 and the potions 173 of the runners 108*b*1,*b*2,*b*3,*b*4 have straight axes. This is quite useful to dispose the throttle bodies 110 between them, because the throttle bodies 110 have also the straight axes as described above. In other words, the throttle bodies 110 are positioned at the portions of the intake ducts 108, which are the almost nearest to the combustion chambers 88 except the curved portions.

In the side elevational view (see FIG. 2), the upstream branch ducts 108*a*1,*a*2,*a*3,*a*4 extend generally horizontally and parallel to each other. The upstream branch ducts 108*a*1,*a*2,*a*3,*a*4 are straight sections. However, the intake manifolds 108*b* are slightly different. The lower runners 108*b*2,*b*4 are slanted so that the distance between the straight sections are less than the distance between the axes of the cylinder bores. In this regard, the cylinder bore axes extend generally horizontally at the same level of the center of the most downstream potion of the runners 108*b*1,*b*2,*b*3, *b*4 in this side view.

That is, the upper runners 108*b*1,*b*3 of the both intake manifolds 108*b* generally horizontally extend. Meanwhile, the lower runners 108*b*2,*b*4 are laid apart from the upper runners 108*b*1,*b*3, respectively, as going downstream so as to be connected to the intake passages 80. In other words, the lower runners 108*b*2,*b*4 extend closely to the upper runners 108*b*1,*b*3 which extend directly above as going upstream. Because of this arrangement, a space 174 is yielded between the second line and the third line of the intake ducts 108. Also another space 176 is yielded below the lowermost line of the air intake duct 108. The spaces 174, 176 are utilized for placing a throttle valve control mechanism 178. The throttle valve control mechanism 178 will be described more in detail later.

The throttle bodies 110 are located at almost midway of the air intake ducts 108. That is, the throttle bodies 110 are nearer to the combustion chambers 88 than being located upstream of the plenum chamber 106. Accordingly, the engine 46 can response to the operator's requirement without much delay, i.e., more quickly as compared with the conventional arrangement. Thus, the operator will not have bad feeling in engine operation.

Length of the induction system 104, more specifically, a total length of air intake duct 108 and the continuing intake passage 80 is an important element in effectively utilizing the inertia charge. That is, if the total length is selected properly, air charge will continue to rush into the combustion chambers 88 by its inertia even after the pistons 72 pass the bottom dead center and turn to move upwardly at a certain range of the engine operation. This phenomenon results in a great improvement of the volumetric efficiency or the charging efficiency. This means that the amount of air entering the combustion chambers 88 per induction stroke greatly increases.

The throttle valve control mechanism 178 will now be described with reference again to FIGS. 1 through 4 and additionally with reference to FIG. 5 below.

As described above, the respective throttle bodies 110 have throttle valves (not shown) therein and these valves are supported by throttle valve shafts 112 each extending generally vertically. The throttle bodies 110 at the uppermost and second lines have a common throttle valve shaft member 112*p*, while the throttle bodies 110 at the third and bottom lines have another common throttle valve shaft member 112*w*. The upper throttle valve shaft member 112*p* and the lower throttle valve shaft member 112*w* are connected with each other at the aforenoted space 174. A throttle lever or actuator 190 is also connected with these members 112*p,w* so as to rotate them. The throttle valve shaft 112 has a return spring 192 urging the throttle shaft 112 to its initial position or initial angle at which the throttle valves are closed. The return spring 192 is wound around the shaft members 112*p,w* and an urging portion 194 is engaged at the throttle lever 190. The throttle lever 190 is supported by a rod 196 that is a component of a throttle link assembly or a shift mechanism 198. The throttle lever 190 is, thus, movable in a plane existing generally horizontally above the air intake duct 108. Meanwhile, the throttle link assembly 198 is movable in a plane existing generally vertically. This will become clearer shortly with the descriptions below.

Although the throttle lever 190 is movable at the top face of the air intake duct 108, it can be disposed at the bottom face of the air intake duct 108.

If the throttle lever 190 is only required to move in proportion to the operator's control, the throttle lever 190 can be simply manipulated by a throttle cable or manipulation member 200. However, the engine 46 is quite often operated at a fixed engine speed within a low or medium speed range and it is required to make the throttle valve control insensitive at this speed range. For this purpose, the throttle link assembly 198 involves a non-linear device 201 between the rod 196 and the throttle cable 200. The throttle cable 200 goes forwardly and is connected to an accelerator lever (not shown) placed on, for example, a steering handle (not shown). The throttle cable 200 is generally positioned at the space 176.

The non-linear device 201 includes a first lever 202 and a second lever 203 jointed by a cam connection 204 with each other. The first lever 202 is pivotally connected to the throttle cable 200 with a connection pin 205 and pivotally affixed at a first pivot shaft or first axis 206 that is mounted on the cylinder block 66 or another portion of the engine 46. The first lever 202 has a cam hole 208 at the opposite end of the connecting portion with the throttle cable 200. The second lever 203 is generally shaped as "L" and pivotally affixed at a second pivot shaft or second axis 209 that is mounted on the crankcase 68 or another portion of the engine 46. The second lever 203 has a pin 212 that interfits the cam hole 208. That is, the cam connection 204 is formed at the opposite side relative to the throttle cable 200.

The second lever 203 has a tubular portion 213 that is pivotally connected with the other part of the second lever 203 at a pivot shaft 214 and is threaded internally. Meanwhile, one end of the rod 196 is also threaded and fitted into the internal thread of the tubular portion 213 of the second lever 203. This thread connection forms a length adjuster 216 because the length between the throttle lever 190 and the pivot shaft 214 can be adjustable by inserting or taking out the threaded portion of the rod 196 from the internal thread of the tubular portion 213 of the second lever 203. The length adjuster 216 is provided for adjusting an initial position or opening of the throttle valves. The length adjuster 216 can be made either at the side of the pivot shaft 214 or at the side of the throttle lever 190.

When the throttle cable 200 is moved toward the direction indicated with the arrow 217, the first lever 202 pivots about the first pivot shaft 206 anti-clockwise as indicated with the arrow 218. The second lever 203, then, pivots about the second pivot shaft 209 clockwise as indicated with the arrow 219. Since the pin 212 of the second lever 203 is interfitted in the cam hole 208, the second lever 203 moves along this cam shape. Then, the second lever 203 pushes the rod 196 as indicated with the arrow 220 and finally the throttle valve shaft 112 is rotated via the throttle lever 190 to bring the throttle valves to open positions. When the throttle cable 200 is released, the throttle lever 196 returns to the initial position and the throttle valve shaft 112 is brought into the closed position.

Figure 6:
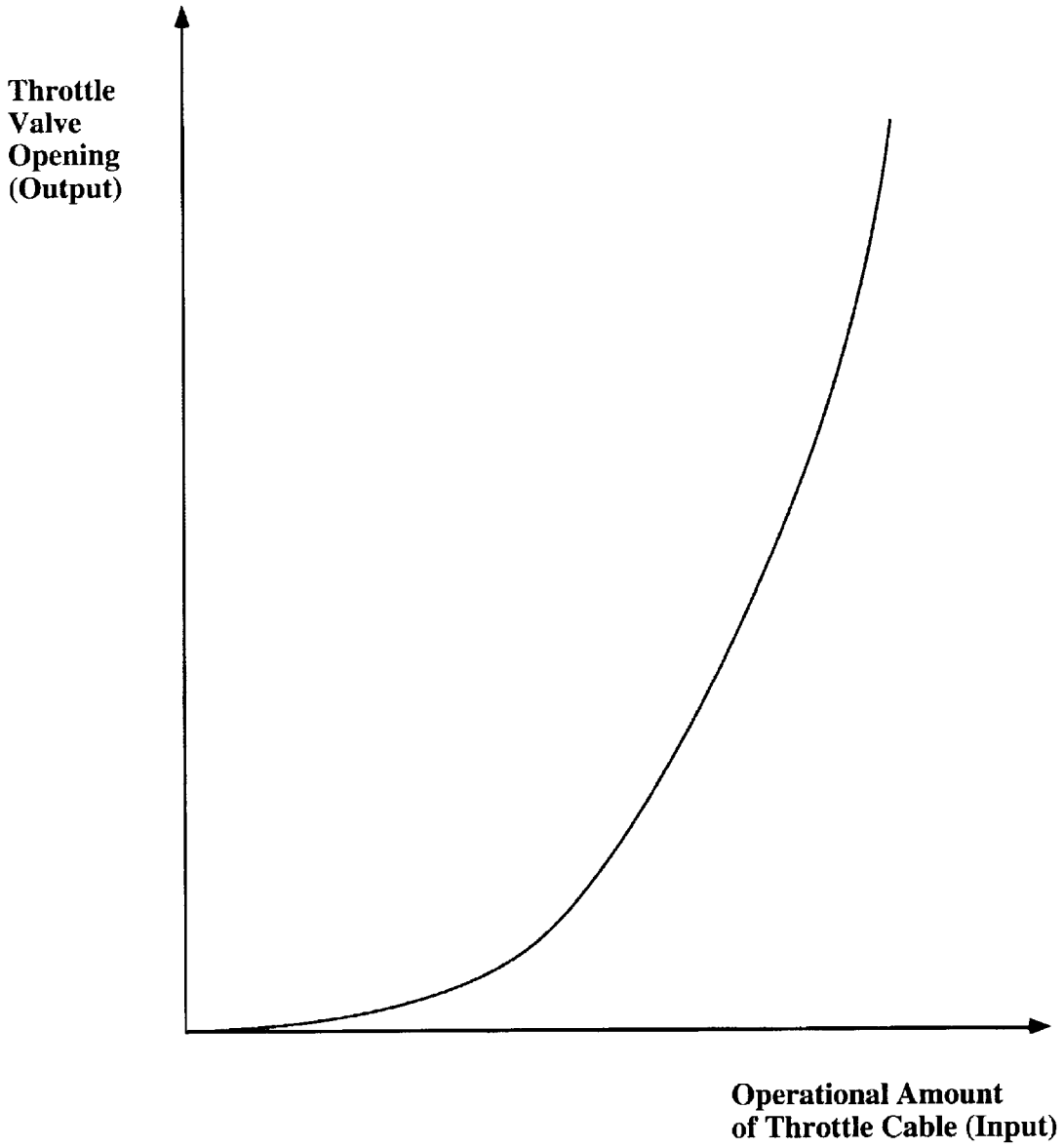
FIG. 6 is a graphical view showing a relationship between the operational amount of a throttle cable (input) and the throttle valve opening (output).

Since the pin 212 moves along the cam shape as described above, the relationship between the operational amount of the throttle cable 200 and the throttle opening is non-linear as shown in FIG. 6. That is, when the movement of the throttle cable 200 is small, the throttle opening is also small. In the meantime, with the large movement of the throttle cable 200, the throttle valve opening abruptly becomes large. In other words, the greater the throttle cable 200 is shifted, the greater the change rate of the amount of movement of the throttle lever 190 increases.

The characteristic is particularly suitable for the operation of the outboard motor 30. As described above, The insensitive change of the throttle valve opening at the small movement of the throttle cable 200 makes it very easy to keep the engine speed in generally fixed state.

As described above, the throttle lever 190 is movable in a plane existing generally horizontally and almost of the other part of the throttle valve control mechanism 178 is movable in a plane generally vertically. That is, the throttle lever 190 can be located in a shadow of the intake duct 108 and the rest, i.e., a large part of the throttle valve control mechanism 178 can be placed between the narrow space between the engine body and the protective cowling.

A throttle position sensor 222 is affixed at the top of the throttle shaft 112 for sensing throttle openings or angles of throttle valves. This throttle position sensor 222 can be affixed at the bottom or halfway of the throttle shaft 112 if space is available.

Incidentally, a switch-over cable 224 is also positioned at the space 176. The switch-over cable 224 is a member of a switch-over mechanism (not shown) for switching over the forward rotation of the propeller 64 to the reverse rotation and vise versa.

The air induction system 104 in this embodiment further has an ISC (idle speed controller) 226 above the vapor separator 130 at the space 142. The ISC 226 is provided for adjusting an amount of air flow to prevent the engine speed from fluctuating at idling state. The ISC 226 is mounted on one of the runners 108*b*1,*b*2,*b*3,*b*4 of the intake manifold 108*b* in a suitable manner. Because of this mount construction, the ISC 226 is hardly heated up by the engine 46 and rather cooled down like the situation of the vapor separator 130. This construction can be applied also for mounting other components such as electrical equipment, which includes the computerized control unit, a regulator rectifier, and other various devices that should not be heated up.

Figure 7:
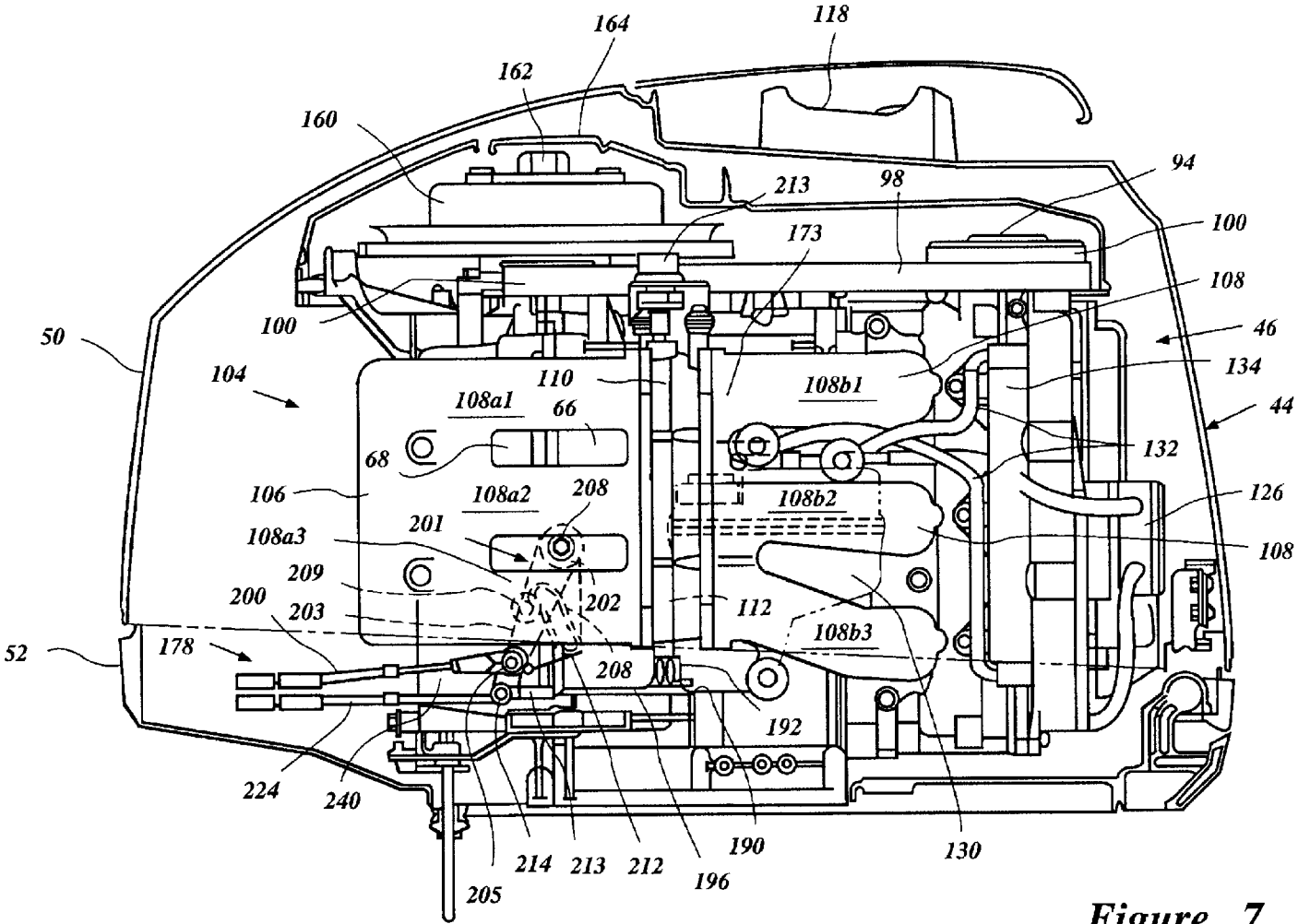
FIG. 7 is an enlarged side elevational view showing a power head incorporating another embodiment of this invention.

FIG. 7 illustrates another embodiment of this invention. The protective cowling 50 and the engine cover 164 are sectioned. The same components and members described above with reference to FIGS. 1 through 5 are assigned with the same reference numerals and will not be described again for avoiding redundancy.

The engine 46 in this embodiment has three cylinders 48 spaced generally vertically relative to each other and the cylinder bores 71 of these cylinders 48 extend generally horizontally. This engine 46, accordingly, has three lines of the air intake ducts 108 comprising the upstream intake duct members 108*a*, a single intake manifold 108*b* and the throttle bodies 110 placed between the upstream duct members 108*a* and the intake manifold 108*b*. The upstream branch ducts 108*a*1,*a*2,*a*3 are integrated with the plenum chamber 106, while the runners 108*b*1,*b*2,*b*3 are integrated together with each other so as to form the intake manifold 108*b*. This construction is similar to that of the engine 46 described above and shown in FIGS. 1 through 4.

The first (uppermost) line of the air intake ducts 108 extends generally horizontally along the cylinder bores 71. Meanwhile, the second and third (bottom) lines extend closely to the lines located directly above them as going upstream. Thus, a space 240 is formed under the third (bottom) line of the air intake ducts 108. A part of the throttle valve control mechanism 178 including the throttle cable 200 and the switch-over cable 224 are placed in this space 240.

A single throttle valve shaft 112, at which three throttle valves are affixed, is provided in this embodiment. The throttle valve control mechanism 178 for controlling the throttle valve shaft 112 is constructed in a slightly different way as compared with the aforedescribed one, but its function is still the same. That is, all parts of the first lever 202 is located higher than the bottom portion of the throttle valve shaft 112 and the first lever 202 is pivotally affixed to the cylinder block 66 at its uppermost position with the first pivot shaft 206. Meanwhile, the second lever 203 is positioned generally upside-down in comparison with the position shown in, for example, FIG. 5 and at a halfway of the first lever 202 and pivotally affixed to the crankcase 68 with the second pivot shaft 209. That is, the cam connection 204 is formed between the first pivot shaft 206 and the connection pin 205 where the throttle cable 200 is connected. The pin 212 of the second lever 203 is intermitted in the cam hole 208 formed at a belly portion of the first lever 202. The rod 196 is, thus, located at the lowermost position and connected to the throttle valve shaft 112 via the throttle lever 190 at the space 240.

Figure 5:
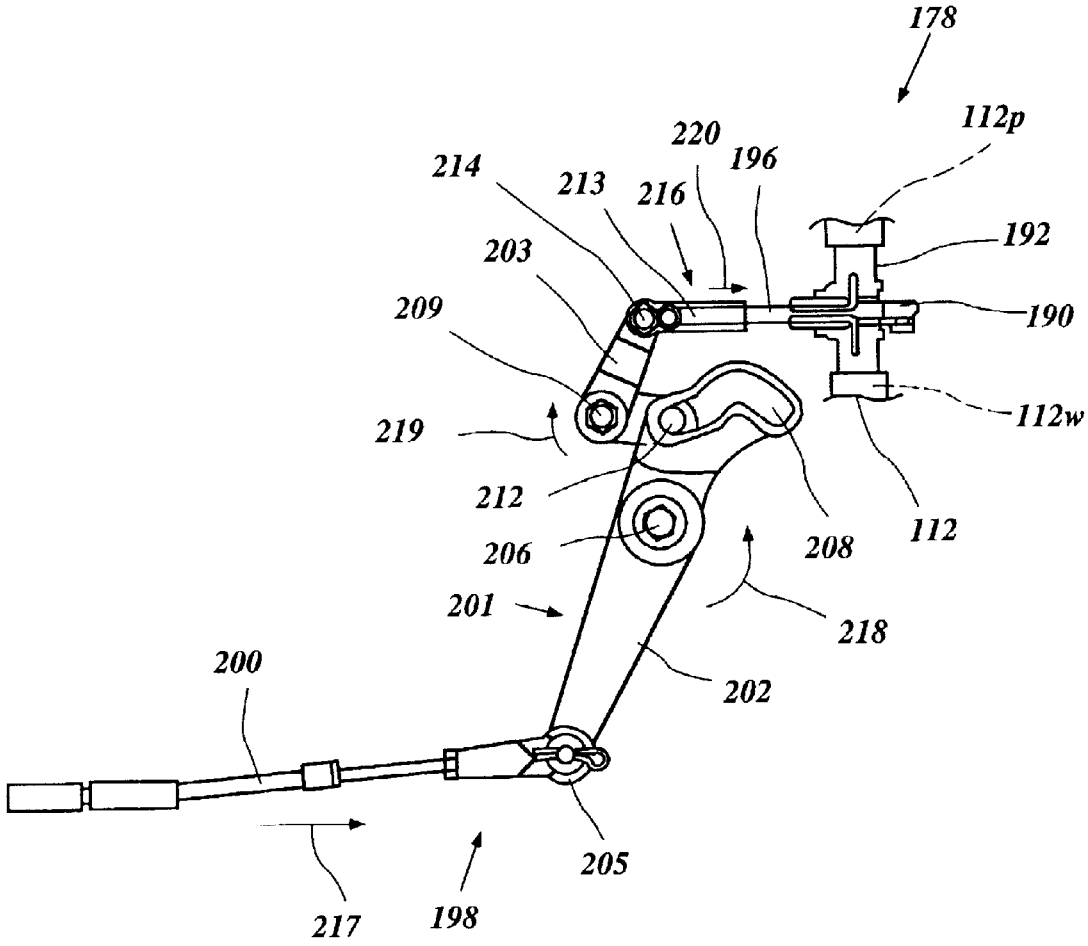
FIG. 5 is an enlarged side elevational view showing a throttle valve control mechanism shown in FIGS. 1 through 4.

Like the throttle valve control mechanism 178 shown in FIG. 5, when the throttle cable 200 is moved, the first lever 202 pivots about the first pivot shaft 206 anti-clockwise. The second lever 203, then, pivots about the second pivot shaft 209 clockwise by the cam connection 204. Since the pin 212 of the second lever 203 is interfitted in the cam hole 208, the second lever 203 moves along this cam shape. Then, the second lever 203 pushes the throttle lever 196 and finally the throttle valve shaft 112 is rotated to bring the throttle valves to the open position. When the throttle cable 200 is released, the throttle lever 196 returns to the initial position and the throttle valve shaft 112 is brought into the closed position. Since the pin 212 moves along the cam shape as described above, the relationship between the operational amount of the throttle cable 200 and the throttle opening is non-linear in this embodiment also.

The throttle valve control mechanism 178 can have various configurations other than the configurations described above inasmuch as its function is not substantially changed. For instance, the cam hole 208 can be replaced with a cam groove. The throttle lever 190 can be placed at the top or almost the top of the throttle valve shaft 112.

The length adjuster 216 may have constructions other than the threaded connection. For instance, several rods which have different lengths can be selectively fitted in the tubular portion 213 that is not threaded. Also, even though the substantial length of the rod 196 is not changed by, for example, the measures aforedescribed, it is still adjustable by changing the relative position of the pivot shaft 214. For example, the second lever 203 can be consisted of two pieces. The relative distance between them should be changeable.

Although the first pivot shaft 206 and the second pivot shaft 209 of the throttle valve control mechanism 178 are mounted on the engine body, they can be mounted on the air intake duct 108. Also, it is practicable that one of the shafts 206,209 is mounted on the engine body and the other shaft is mounted on the air intake duct 108.

The air intake ducts 108 can have various configurations other than the configurations described above. For instance, instead of the inclined runners of the intake manifolds, the upstream duct members in the same lines can be inclined. Moreover, the intake ducts including the inclined runners can be inclined all over themselves.

It should be noted that the greater part of features of this invention is applicable with two stroke crankcase compression engines.

Also, the engine may have other number of cylinders and even a single cylinder is available inasmuch as the following claims do not recite otherwise.

Further, the engine can have the V-shape or other various configurations and the locations of the air induction system and the exhaust system are exchangeable.

The aforedescribed fuel injectors can be replaced with another type of fuel injector such that directly spraying fuel into the combustion chambers. Even conventional carburetors can replace the fuel injectors.

Furthermore, this engine can be utilized for other various purposes, for example, other vehicles such as lawn mowers and golf carts.

Of course, the foregoing description is that of preferred embodiments of the invention, and various changes and modifications may be made without departing from the spirit and scope of the invention, as defined by the appended claims.

What is claimed is:

1. An internal combustion engine comprising a plurality of generally horizontally extending cylinder bores spaced apart vertically from each other, a plurality of pistons each reciprocating within the respective cylinder bores, a cylinder head closing one end of said cylinder bores, said cylinder bores, said pistons and said cylinder head together defining a plurality of combustion chambers, an air induction system communicating with said combustion chambers for supplying air charges thereto, said air induction system including a plurality of air intake ducts, each one of said air intake ducts having a throttle valve for admitting the air charge to said combustion chamber, each one of said throttle valves having a valve shaft which axis extends generally vertically, the respective throttle valves being linked together, an actuator movable in a plane existing generally horizontally for rotating said valve shafts about the axes so that the openings of said throttle valves are controlled, a manipulation member adapted to be movable by an operator, and a non-linear device for non-linearly moving said actuator in response to the movement of said manipulation member, said non-linear device movable in a plane existing generally vertically, said non-linear device including a first lever pivotally movable about a first axis extending generally horizontally by said manipulation member, and a second lever pivotally movable about a second axis extending generally horizontally by said first lever, said first and second levers being engaged with each other through a cam connection, and said non-linear device further including a shift member reciprocally movable by said second lever to move said actuator.

2. An internal combustion engine as set forth in claim 1 wherein said cam connection is formed at a portion of said first lever opposite to said manipulation member relative to said first axis.

3. An internal combustion engine as set forth in claim 1 wherein said cam connection is formed at a portion of said first lever between said first axis and said manipulation member.

4. An internal combustion engine as set forth in claim 1 wherein said second lever and said shift member are pivotally connected.

5. An internal combustion engine as set forth in claim 1 wherein said manipulation member and said first lever are pivotally connected.

6. An internal combustion engine as set forth in claim 1, wherein an adjustment mechanism for adjusting an initial position of said throttle valves is located between said cam connection and said actuator.

7. An internal combustion engine as set forth in claim 6, wherein said adjustment mechanism is configured to adjust the length of said shift member.

8. An internal combustion engine as set forth in claim 1, wherein the non-linear device is configured such that the more the manipulation member is moved from an initial position that corresponds to an idle throttle valve position, the greater the rate of change rate of the throttle valve opening degree versus actuator movement.

9. An internal combustion engine as set forth in claim 1, wherein said non-linear device is placed between one side of said engine and said air intake ducts.

10. An internal combustion engine as set forth in claim 9, wherein said non-linear device is mounted on said engine.

11. An internal combustion engine comprising a plurality of generally horizontally extending cylinder bores spaced apart vertically from each other, a plurality of pistons each reciprocating within the respective cylinder bores, a cylinder head closing one end of said cylinder bores, said cylinder bores, said pistons and said cylinder head together defining a plurality of combustion chambers, an air induction system communicating with said combustion chambers for supplying air charges thereto, said air induction system including a plurality of air intake ducts, each one of said air intake ducts having a throttle valve for admitting the air charge to said combustion chamber, each one of said throttle valves having a valve shaft which axis extends generally vertically, the respective throttle valves being linked together, an actuator movable in a plane existing generally horizontally for rotating said valve shafts about the axes so that the openings of said throttle valves are controlled, said actuator being movable between two of said air intake ducts, a manipulation member adapted to be movable by an operator, and a non-linear device for non-linearly moving said actuator in response to the movement of said manipulation member, non-linear device movable in a plane existing generally vertically.

12. An internal combustion engine as set forth in claim 11, wherein each one of said air intake ducts includes at least three pieces, one of said pieces includes a throttle body, and said throttle valve is positioned in said throttle body.

13. An internal combustion engine as set forth in claim 12, wherein the piece including said throttle body is placed between two other pieces.

14. An internal combustion engine as set forth in claim 11 wherein said actuator is movable at the bottom end of said valve shafts.

15. An internal combustion engine as set forth in claim 11 additionally comprising a position sensor for sensing opening positions of said throttle valves, wherein said position sensor is coupled to at least one of said valve shafts.

16. An internal combustion engine as set forth in claim 15 wherein said position sensor is located at the top end of said valve shafts.

17. An internal combustion engine as set forth in claim 1, wherein said actuator includes a control lever, one end of said control lever is coupled to said valve shafts, and the other end of said control lever is connected to said non-linear device.

18. An internal combustion engine as set forth in claim 11, wherein said induction system further includes a plenum chamber disposed upstream of said air intake ducts.

19. An internal combustion engine as set forth in claim 11, wherein said engine is configured to operate on a four stroke combustion principle.

20. An internal combustion engine as set forth in claim 11 in combination with an outboard motor, wherein said engine is surrounded by a protective cowling of the outboard motor.

21. An internal combustion engine comprising an engine body defining a cylinder bore, a piston reciprocating within said cylinder bore, a cylinder head closing said cylinder bore, said cylinder bore, said piston and said cylinder head together defining a combustion chamber, an air induction system for supplying an air charge to said combustion chamber, said air induction system including a throttle valve for admitting the air charge to said combustion chamber, said throttle valve having a valve shaft pivotal about a valve axis, and a control mechanism arranged to activate said valve shaft non-linearly as compared with an input operation thereof, said control mechanism generally extending in a vertical plane and activating said valve shaft by a movement in said vertical plane, said control mechanism including a first lever pivotally movable about a first axis extending generally horizontally, a second lever pivotally movable about a second axis extending generally horizontally, said first and second levers being engaged with each other through a cam connection, and a control linkage coupled with the valve shaft, the control linkage being movable by a movement of the second lever so as to activate the valve shaft.

22. An internal combustion engine as set forth in claim 21 in combination with an outboard motor, wherein said engine is surrounded by a protective cowling of the outboard motor.

23. An internal combustion engine comprising a cylinder block defining a cylinder bore extending generally horizontally, a piston reciprocating within the cylinder bore, a cylinder head member closing one end of the cylinder bore and defining a combustion chamber with the cylinder bore and the piston, a crankcase coupled with the cylinder block, an air intake conduit arranged to supply air to the combustion chamber and extending generally horizontally, a throttle valve journaled in the air intake conduit for pivotal movement and to regulate air flow through the air intake conduit in proportion to the degree of the pivotal movement, a first member pivotally moveable in a first plane extending generally vertically and operable by an operator, a second member connected to the throttle valve and pivotally moveable in a second plane extending generally vertically, the first and second members being journaled for the respective pivotal movements on either one of the cylinder block or the crankcase, and a cam connection coupling the first member with the second member through which the first member moves the second member non-linearly relative to the movement of the first member.

24. An internal combustion engine as set forth in claim 23, wherein the cam connection includes a cam portion disposed on the first member and a cam follower portion disposed on the second member.

25. An internal combustion engine as set forth in claim 24, wherein the cam portion is defined as a cam hole and the cam follower portion includes a pin moveable within the cam hole.

26. An internal combustion engine comprising a cylinder block defining a cylinder bore extending generally horizontally, a piston reciprocating within the cylinder bore, a cylinder head member closing one end of the cylinder bore and defining a combustion chamber with the cylinder bore and the piston, an air intake conduit arranged to supply air to the combustion chamber and extending generally horizontally, a throttle valve journaled in the air intake conduit for pivotal movement and to regulate air flow through the air intake conduit in proportion to the degree of the pivotal movement, a first member pivotal in a first plane extending generally vertically and operable by an operator, a second member connected to the throttle valve and pivotal in a second plane extending generally vertically, and a cam connection coupling the first member with the second member through which the first member moves the second member non-linearly relative to the movement of the first member, a third member coupled with the throttle valve, the throttle valve being pivotal about a valve axis extending generally vertically, the third member extending normal to the valve axis and being pivotal in a third plane extending generally horizontally, and a linkage arranged to couple the third member with the second member whereby the pivotal movement of the second member in the second plane is transferred to the pivotal movement of the third member in the third plane.

27. An internal combustion engine as set forth in claim 26, wherein a lever affixed to the throttle valve defines the third member, a push rod affixed to the second member for pivotal movement defines the fourth member, and the valve axis is offset from the second plane.

28. An internal combustion engine comprising an engine body defining a cylinder bore, a piston reciprocating within said cylinder bore, a cylinder head closing said cylinder bore, said cylinder bore, said piston and said cylinder head together defining a combustion chamber, an air induction system for supplying an air charge to said combustion chamber, said air induction system including a throttle valve for admitting the air charge to said combustion chamber, said throttle valve having a valve shaft pivotal about a valve axis extending generally vertically, and a control mechanism arranged to actuate said valve shaft non-linearly as compared with an input operation thereof, said control mechanism generally extending in a vertical plane and actuating said valve shaft by a movement in said vertical plane, said control mechanism including a first lever pivotally movable about a first axis extending generally horizontally, a second lever pivotally movable about a second axis extending generally horizontally, said first and second levers being engaged with each other through a cam connection, and a control linkage coupled with both the valve shaft and the second lever, the control linkage being movable by a movement of the second lever so as to actuate the valve shaft.

29. An internal combustion engine comprising a cylinder block defining a plurality of cylinder bores extending generally horizontally and spaced apart vertically from each other, pistons reciprocating within the respective cylinder bores, a cylinder head member closing one end of the cylinder bores and defining a plurality of combustion chambers with the cylinder bores and the pistons, a plurality of air intake conduits arranged to supply air to the respective combustion chambers, the air intake conduits extending generally horizontally and spaced apart vertically from each other, throttle valves each journaled in each one of the intake conduits for pivotal movement, the throttle valves linked together by a common shaft through which a common pivot axis of the throttle valves extends, and a control mechanism arranged to control the pivotal movement of the throttle valves, the control mechanism including a linkage coupled with the common shaft, and the linkage is located between two of the air intake conduits.

30. An internal combustion engine as set forth in claim 29, wherein the control mechanism includes a first member pivotal in a first plane extending generally vertically, a second member connected to the throttle valve and pivotal in a second plane extending generally vertically, and a cam connection coupling the first member with the second member.

31. An internal combustion engine comprising an engine body having an outer surface, the engine body defining a cylinder bore, a piston reciprocating within the cylinder bore, a cylinder head member closing one end of the cylinder bore and defining a combustion chamber with the cylinder bore and the piston, an air intake conduit arranged to supply air to the combustion chamber, the air intake conduit extending along the outer surface of the engine body, a throttle valve journaled in the air intake conduit for pivotal movement and to regulate the air flow through the air intake conduit in proportion to the degree of pivotal movement, and a non-linear mechanism arranged to actuate the throttle valve non-linearly as compared with an input operation thereof, the non-linear mechanism being moveable in a plane extending generally in parallel to the outer surface of the engine body and in a space defined between the outer surface of the engine body and the air intake conduit.

32. An internal combustion engine as set forth in claim 31, wherein the mechanism includes a first member pivotal in a first plane extending generally parallel to the outer surface of the engine, a second member connected to the throttle valve and pivotal in a second plane extending generally parallel to the outer surface of the engine, and a cam connection coupling the first member with the second member through which the first member moves the second member.

33. An outboard motor comprising a housing unit, said housing unit comprising a powerhead, said powerhead comprising a cowling assembly and an engine disposed within said cowling assembly, said engine comprising at least one cylinder bank, at least two cylinders defined within said at least one cylinder bank, said at least two cylinders partially defining respective combustion chambers, an induction system communicating with said combustion chambers, said induction system comprising a plenum chamber disposed generally forward of said engine within said cowling assembly, at least two air intake passages extending rearward from said plenum chamber toward said combustion chambers, a space defined between said air intake passages and a side surface of said engine, a throttle valve disposed within each air intake passage, said throttle valve rotating about a generally vertical axis, a throttle valve control mechanism comprising a first lever that is pivotal about a generally horizontal axis, said first lever being operatively connected to a second lever, said second lever also being pivotal about a generally horizontal axis and said second lever being operatively connected to a shaft that moves said throttle valves about said generally vertical axis, said first lever extending through said space and being capable of pivoting with said space.

34. The outboard motor of claim 33, wherein said second lever and said first lever are connected such that relative movement of said first lever and said second lever is nonlinear.

35. The outboard motor of claim 33, wherein a second end of said first lever is connected to a first end of said second lever, movement of said second end of said first lever comprising a horizontal component and a vertical component and movement of said first end of said second lever also comprising a horizontal component and a vertical component, said first lever and said second lever being connected such that, when initiating opening of said throttle valves from a substantially closed position, said second end of said first lever undergoes relatively more horizontal movement than said first end of said second lever such that positioning of said throttle valves is less sensitive to initial movement of an actuator when said throttle valves are substantially closed.

36. An internal combustion engine comprising an engine body, a moveable member moveable within the engine body, the engine body and the moveable member together defining a combustion chamber, an air intake system arranged to introduce air to the combustion chamber, the air intake system including an air intake conduit, a throttle valve configured to regulate air flow through the air intake conduit, the throttle valve having a valve shaft journaled for pivotal movement on the air intake conduit, a first lever adapted to be operated by an operator, a second lever connected to the valve shaft, the first and second levers being journaled for pivotal movement on the engine body, and a cam connection configured to couple the second lever with the first lever, the second lever being moveable non-linearly relative to the first lever.

37. The engine as set forth in claim 36, wherein the valve shaft being moveable about a valve axis extending generally vertically, the first lever being moveable about a first axis extending generally horizontally, and the second lever being moveable about a second axis extending generally horizontally.

38. The engine as set forth in claim 37 additionally comprising a linkage mechanism connecting the second lever to the valve shaft.

* * * * *